US007399092B2

(12) United States Patent
Heckel, II et al.

(10) Patent No.: US 7,399,092 B2
(45) Date of Patent: Jul. 15, 2008

(54) VARIABLY MOUNTABLE MULTIPLE COLORED SAFETY AND NOVELTY REFLECTOR AND METHOD FOR MAKING SAME

(76) Inventors: Robert D. Heckel, II, 1176 Tyson Rd., Eagle River, WI (US) 54521; Richard D. Heckel, 669 Springview Rd., Eagle River, WI (US) 54521; Richard C. Kochanski, N3014 County Road I, Waldo, WI (US) 53093

( * ) Notice: Subject to any disclaimer, the term of this patent is extended or adjusted under 35 U.S.C. 154(b) by 0 days.

(21) Appl. No.: 11/577,480

(22) PCT Filed: Oct. 17, 2005

(86) PCT No.: PCT/US2005/037362

§ 371 (c)(1),
(2), (4) Date: Apr. 18, 2007

(87) PCT Pub. No.: WO2006/044854

PCT Pub. Date: Apr. 27, 2006

(65) Prior Publication Data

US 2008/0013197 A1 Jan. 17, 2008

Related U.S. Application Data

(60) Provisional application No. 60/619,878, filed on Oct. 18, 2004.

(51) Int. Cl.
*G02B 5/136* (2006.01)

(52) U.S. Cl. ..... 359/546

(58) Field of Classification Search ..... 359/838, 359/839, 546–548
See application file for complete search history.

(56) References Cited

U.S. PATENT DOCUMENTS 5,442,870 A * 8/1995 Kochanowski ..... 40/582
6,128,842 A * 10/2000 Lotspeich et al. ..... 40/606.02

* cited by examiner

*Primary Examiner*—Euncha P Cherry
(74) *Attorney, Agent, or Firm*—Joseph S. Heino; Patrick M. Bergin

(57) ABSTRACT

A reflector (10) includes a frame (20) and reflector pieces (40, 50). The frame (20) is made of a light-opaque material and the reflector pieces (40, 50) are made of semi-light-transparent materials, preferably color tinted. The frame (20) includes frame portions (22, 24, 26, 28) that are, in cross-section, L-shaped members that support and cover the edge of a flat object when that object is placed within the frame (20). The frame (20) includes a plurality of bands (32, 34, 36). Between the bands (32, 34, 36) are voids (33, 35). The bands (32, 34, 36) include rearwardly extending posts (38). A first reflector piece (40) includes a reflector surface (42) surrounded by a flat border (44). The reflector surface (42) is made up of a plurality of pyramidal elements (46), that are intended to reflect light back toward a light source in a generally light-scattering and diffusing manner. The border (44) of the first reflector piece (40) includes a plurality of apertures (48), each of which corresponds to a complementary post (38).

14 Claims, 11 Drawing Sheets

VARIABLY MOUNTABLE MULTIPLE COLORED SAFETY AND NOVELTY REFLECTOR AND METHOD FOR MAKING SAME

This application claims the benefit and priority of U.S. Provisional Patent Application 60/619,878 filed Oct. 18, 2004.

FIELD OF THE INVENTION

The present invention relates generally to reflectors used by motorists and non-motorists to identify mobile and immobile objects at night. More particularly, the present invention relates to a novelty safety reflector that utilizes multiple pieces of reflective material to assume the shape of a flag, the reflector being variably mountable to a number of objects by use of, among other things, brackets, holders, magnetic strips and adhesive strips.

BACKGROUND OF THE INVENTION

During evening hours, stationary objects that are situated alongside a roadway, and objects moving along the roadway, present a special visibility hazard to users of the roadway. The use of motor vehicle headlights provides some degree of protection for night-time travelers and reduces that hazard substantially. However, light reflective surfaces and devices have long been used to further reduce this visibility hazard by enhancing the amount of light that is reflected back to the vehicle operator. For example, small plastic reflectors have been mounted to rods that are strategically placed at corners and at the edges of driveways to safely guide a motorist along that corner or driveway. Reflectors and reflective tapes have been used to identify mailboxes and other stationary objects located at the side of the roadway. Very often, the roadway itself may contain imbedded reflective lane markers to assist users of the roadway to stay within a certain lane of traffic which traveling at night. Each of these examples is a typical use of light reflective devices or surfaces that are well known in the art. Also well known is the fact that each of these reflective objects tends to be monochromatic in application.

In the experience of these inventors, what has not been done in the prior art is to use a safety marker in the form of a reflector where multiple pieces or multiple colors of reflective material are used in combination with an overlay material to make the reflector decorative as well as functional, and without diminishing its safety qualities. Accordingly, what is needed is a reflector that can be used as a safety device and as a message-giving device at the same time, the reflector using multiple colors or multiple pieces of reflective material and an overlay material to selectively divide the different reflective colors or pieces to thereby form a design. What is also needed is an easy way to fabricate and assemble the reflector such that a minimal number of parts are used and a minimal number of steps are used to assemble the reflector. What is also needed is a versatile way to mount the reflector to magnetic or non-magnetic surfaces, to mount the reflector as a stand-alone object, and to combine the reflector with an advertising frame or other retailer or source identifier as required or desired. Finally, what is also needed is a reflector that can be specifically formed into a flag arrangement, using a color scheme such that the reflector can replicate the colors of a flag, whereby the reflector can be used for safety purposes as well as for providing the user with a patriotic display.

Accordingly, it is an object of the present invention to provide a new and useful reflector that can be used as a safety device and as a message-giving device at the same time. It is another object to provide a reflector that is easy to fabricate and assemble. It is still another object to provide a reflector that can be mounted to a magnetic or non-magnetic surface, as a stand-alone object, or combined with an advertising frame or other source identifier. It is yet other object to provide such a reflector that is specifically formed into a flag arrangement, using a color scheme such that the reflector replicates the colors of a flag.

SUMMARY OF THE INVENTION

The novelty safety reflector of the present invention has obtained these objects. It provides for at least one piece of reflective material of one color, and preferably two pieces of reflective material each being of a different color, as the background of the reflector. The reflective material is covered by an overlay material that essentially "frames in" the reflective material to form the intended visual display. The completed reflector can be backed with an adhesive material for mounting to a non-magnetic object. The reflector can also be backed with a magnetic material for mounting to a magnetically-metallic object. The reflector can also be placed within a frame for advertising or promotional purposes, much like the license plate holder that is attached to a motor vehicle by the dealer who sold the vehicle. A pair of such reflectors can be placed back-to-back and mounted within a frame, the frame being a stand-alone item supported by a rod, for example.

The foregoing and other features of the reflector of the present invention will be apparent from the detailed description that follows.

DETAILED DESCRIPTION

Figure 1:
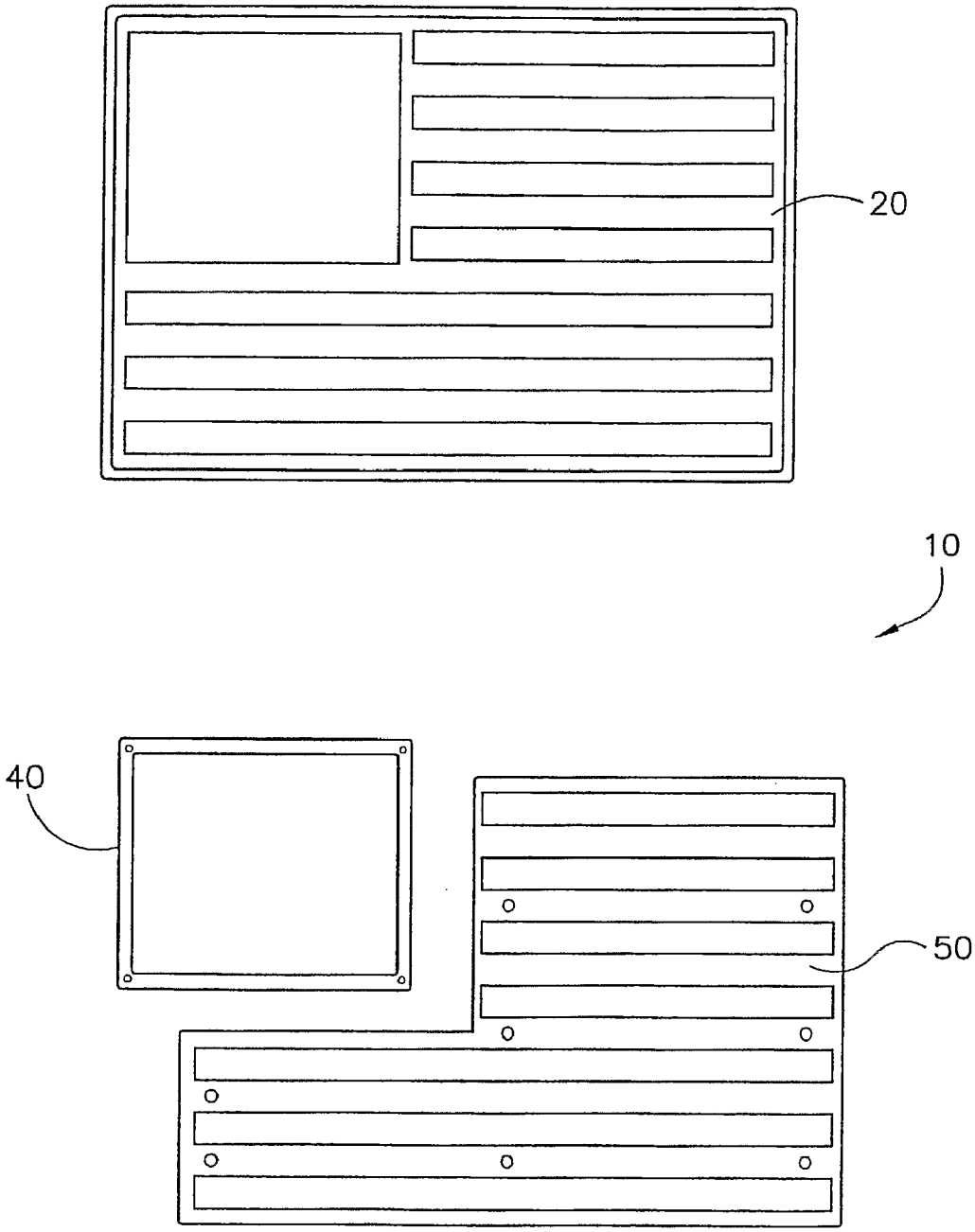
FIG. 1 is a front elevational view of the essential elements of a reflector constructed in accordance with the present invention.

Referring now to the drawings in detail wherein like numbers represent like elements throughout, FIG. 1 illustrates a reflector, generally identified 10, constructed in accordance with the present invention. As shown, the reflector 10 in the preferred embodiment is generally comprised of a reflector frame 20 having a generally rectangular configuration, a first reflector piece 40 and a second reflector piece 50. In the preferred embodiment, the reflector frame 20 is made of a light-opaque material and the reflector pieces 40, 50 are made of semi-light-transparent materials, preferably each being color tinted.

Figure 2:
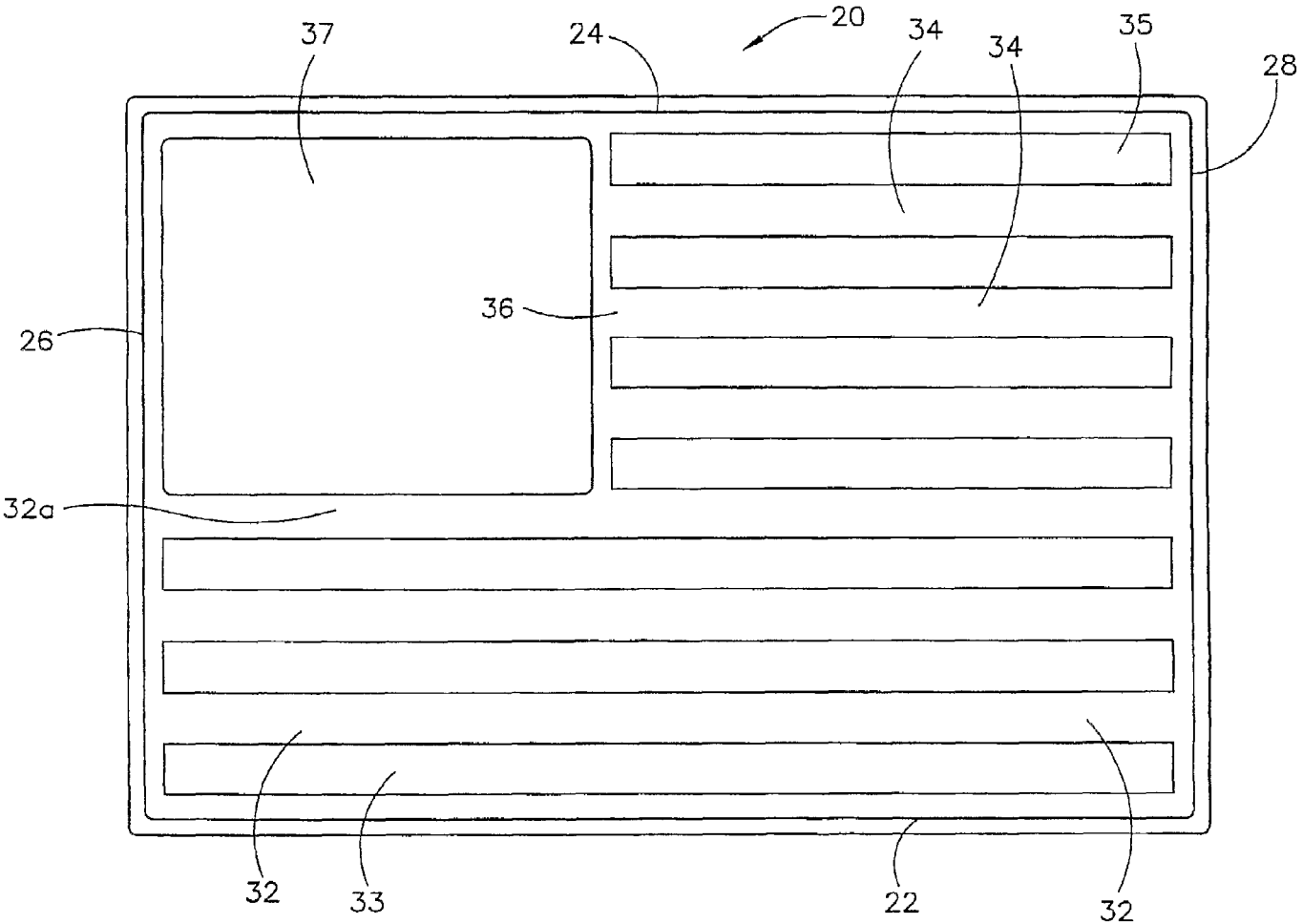
FIG. 2 is an enlarged front elevational view of the frame of the reflector shown in FIG. 1.
Figure 3:
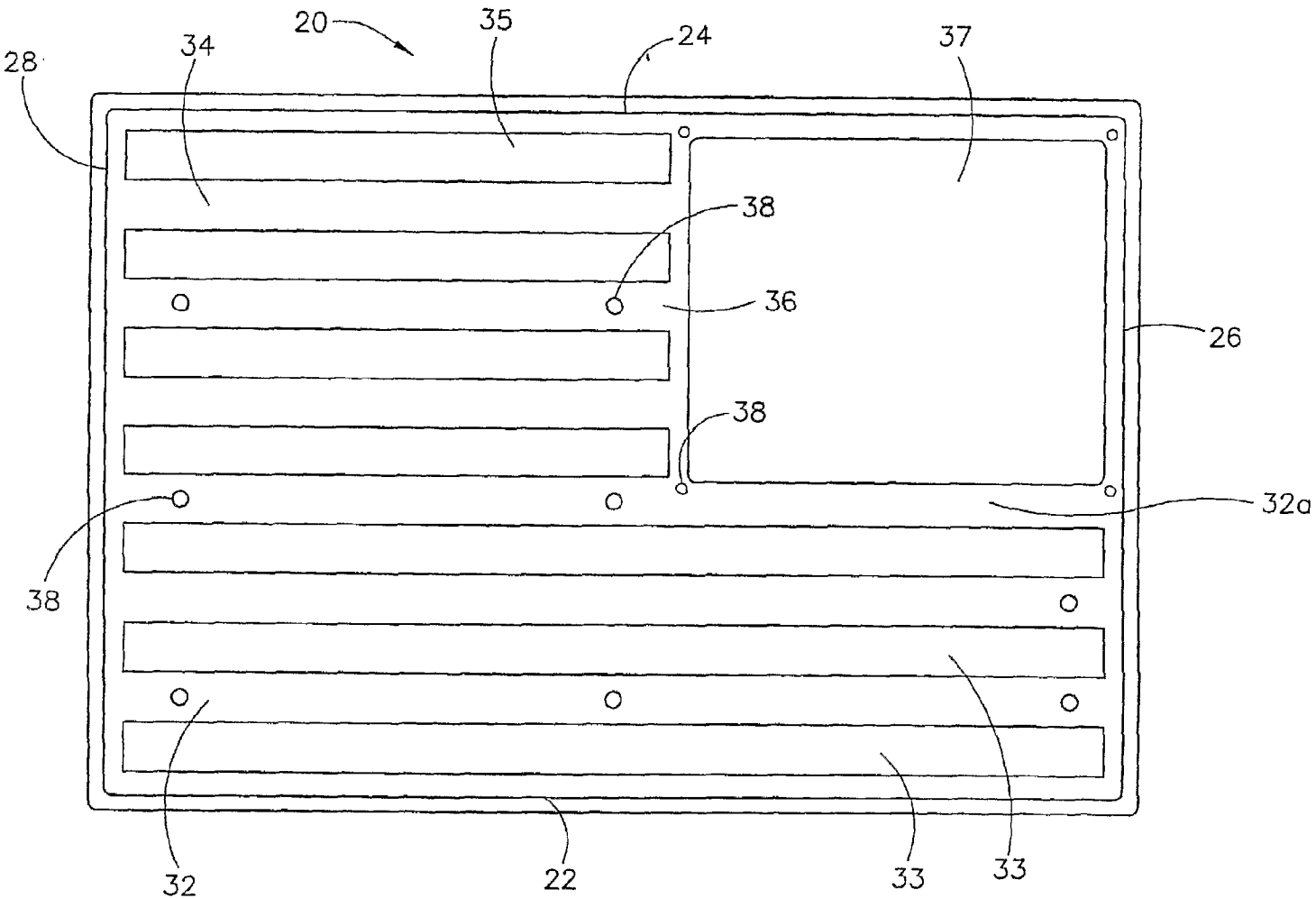
FIG. 3 is a rear elevational view of the frame shown in FIG. 2.
Figure 4:
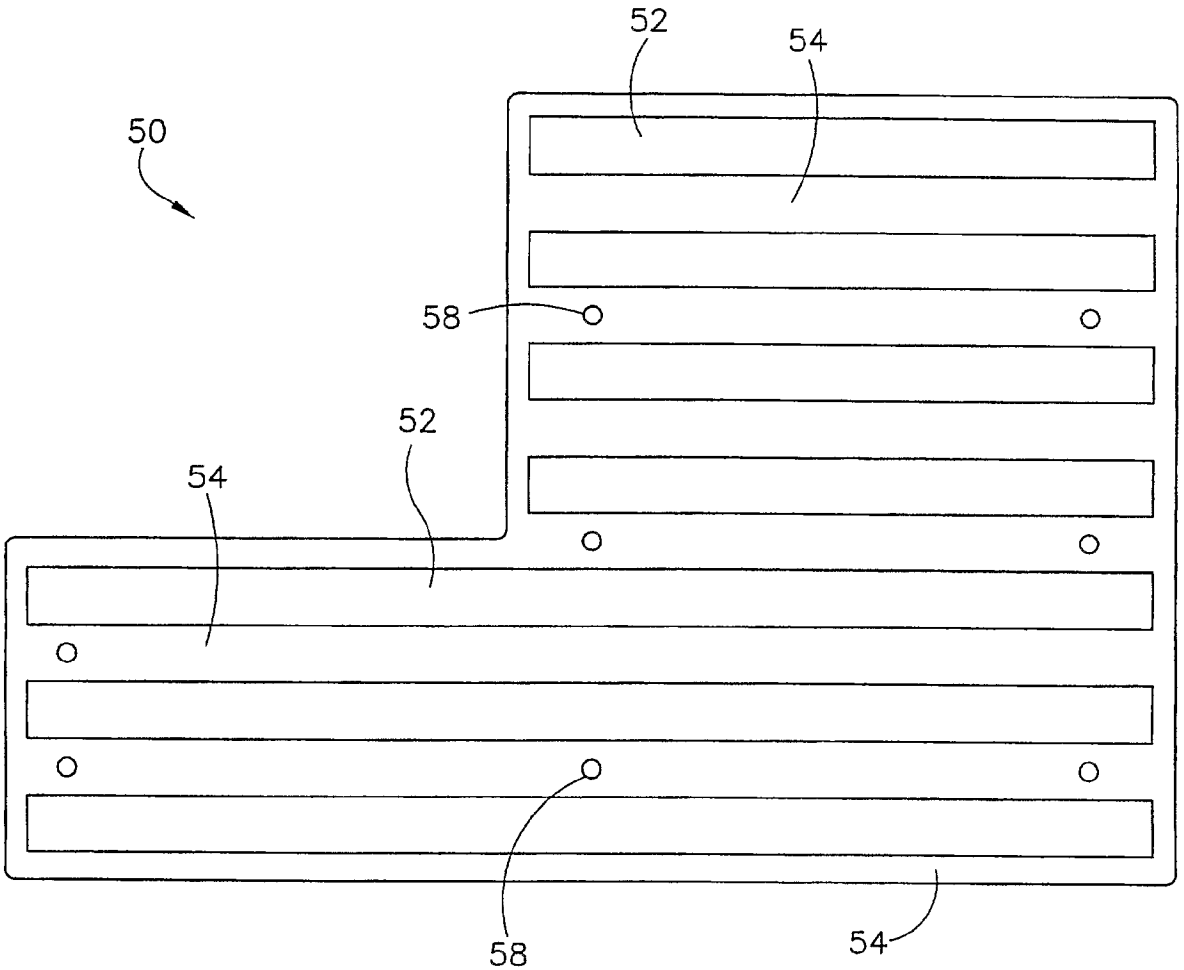
FIG. 4 is an enlarged front elevational view of the first reflector piece shown in FIG. 1.
Figure 5:
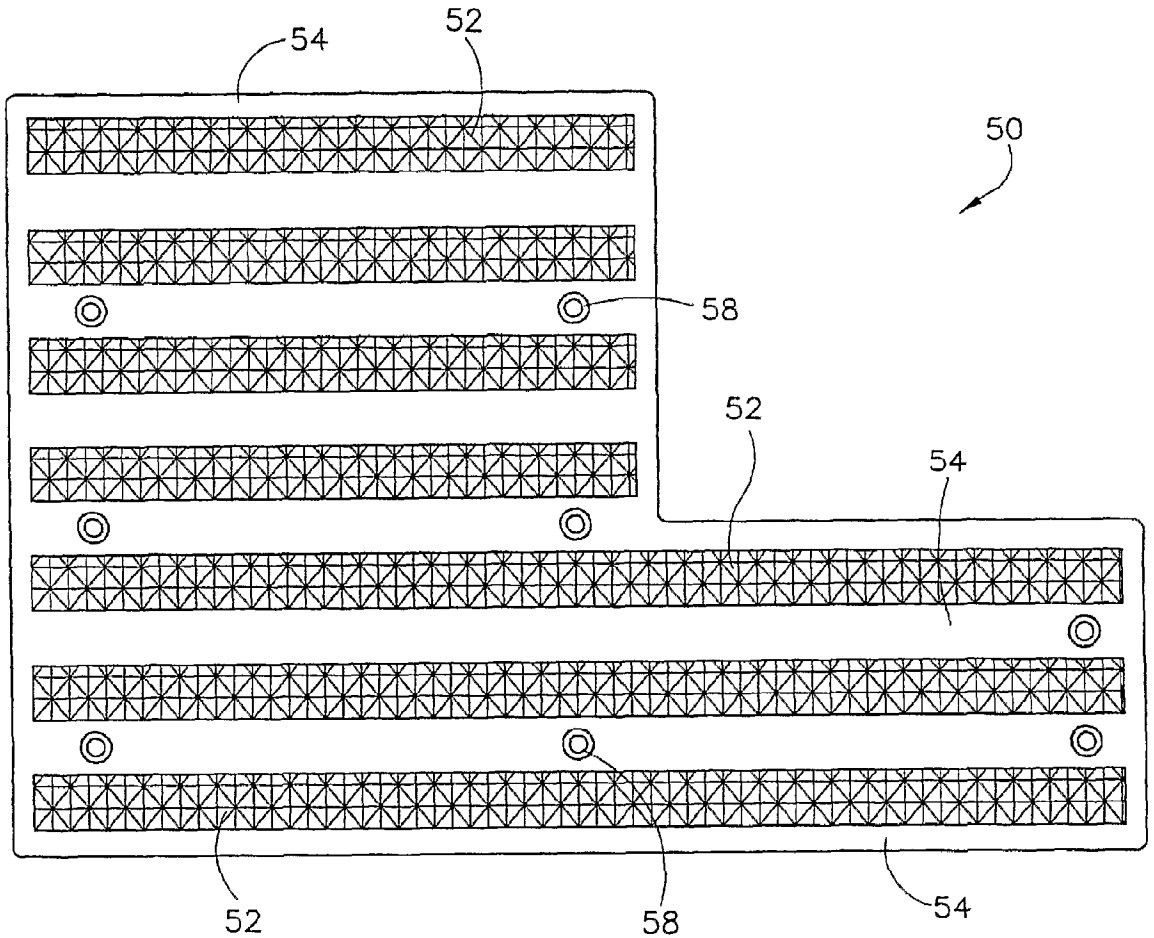
FIG. 5 is a rear elevational view of the first reflector piece shown in FIG. 4.
Figure 6:
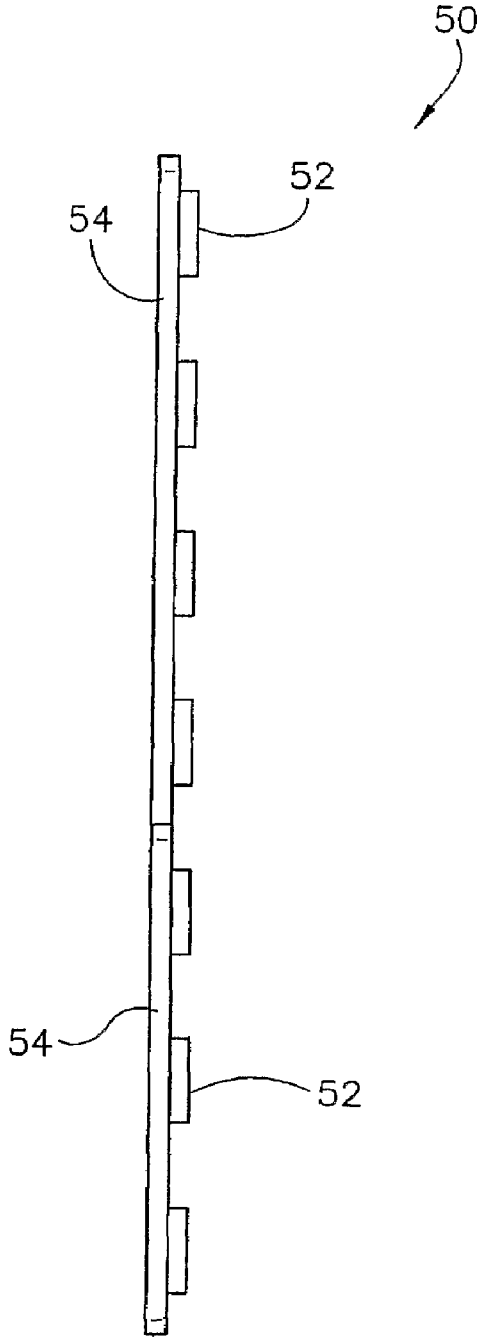
FIG. 6 is a side elevational view of the first reflector piece shown in FIG. 4.
Figure 9:
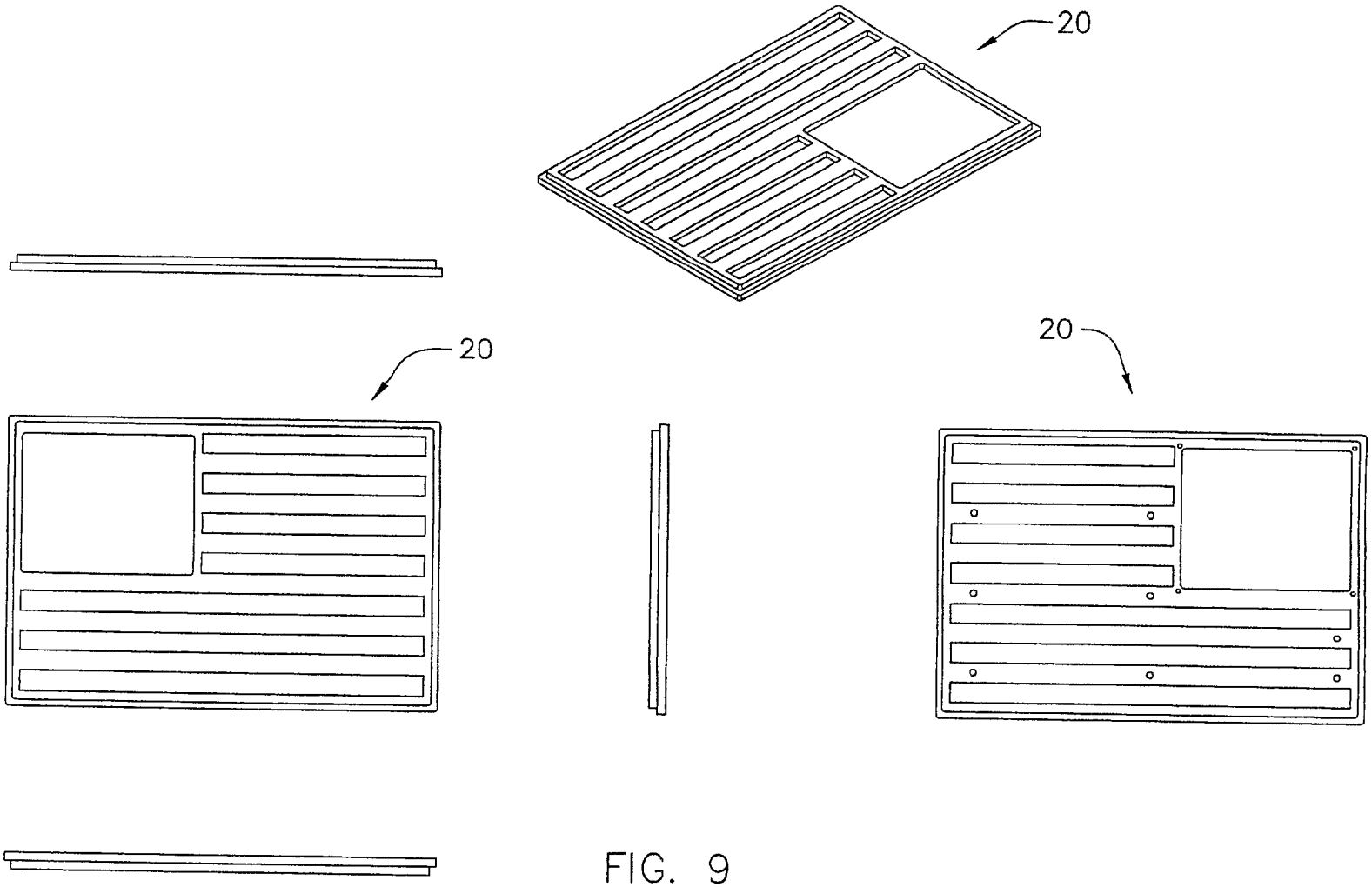
FIG. 9 is a series of reduced elevational, plan and perspective views of the reflector frame shown in FIG. 1.
Figure 10:
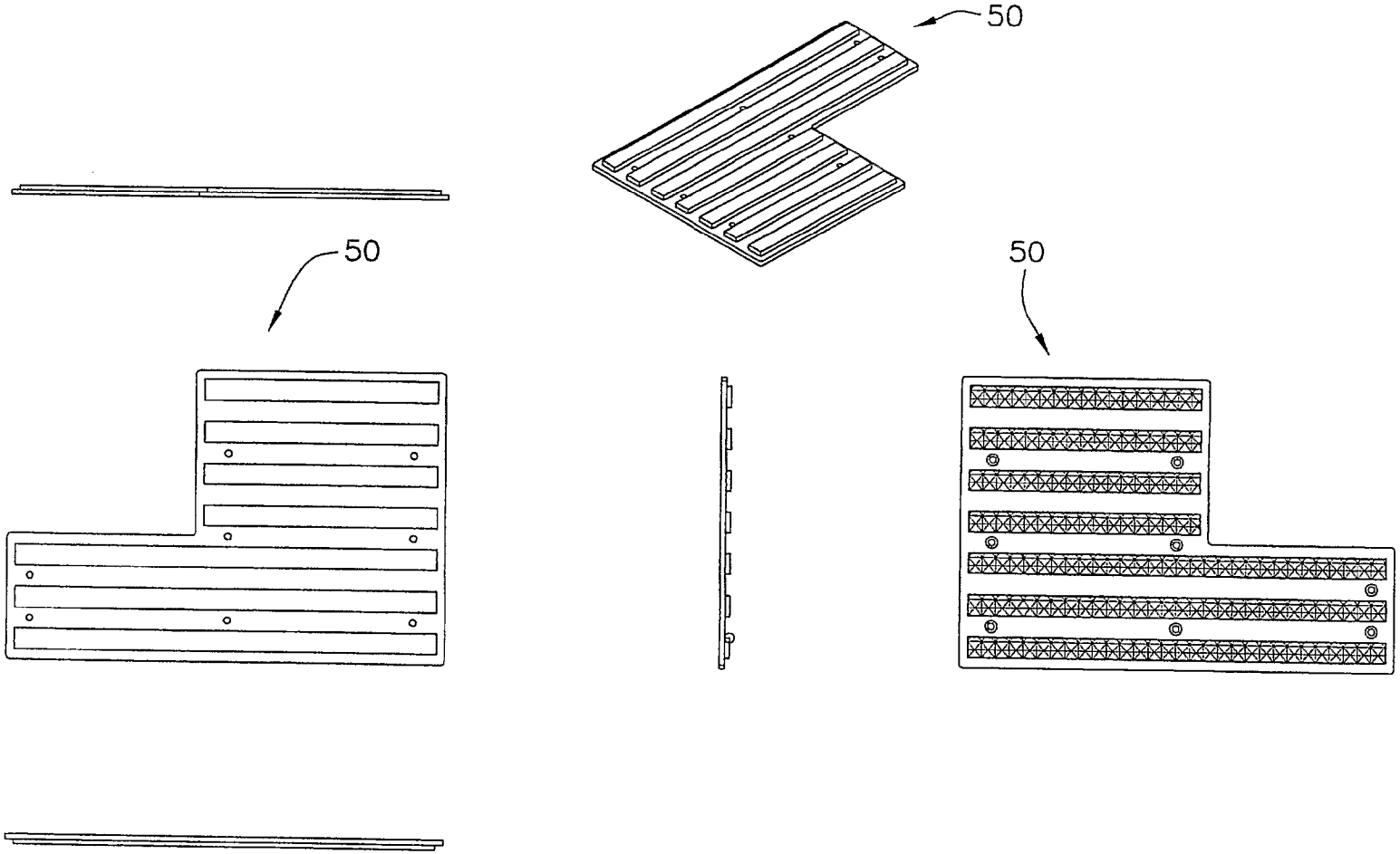
FIG. 10 is a series of reduced elevational, plan and perspective views of the second reflector piece shown in FIG. 1.

Referring now to FIGS. 2, 3 and 9, it will be seen that the frame 20 includes a frame bottom portion 22, a frame top portion 24, a frame first side portion 26 and a frame second side portion 28. In the preferred embodiment, the bottom and top frame portions 22, 24 are somewhat longer than are the side portions 26, 28. Each of the frame portions 22, 24, 26, 28 is, in cross-section, an "L-shaped" member which is functionally adapted to support and cover the edge of another substantially flat object when that object is placed within the frame 20. In the preferred embodiment, the frame 20 is configured substantially in the shape of a flag of the United States and includes a plurality of horizontally disposed bands 32, 34. Between the bands 32, 34 are horizontally disposed voids 33, 35. In the lower portion of the overall flag field, the bands 32 run from one side frame portion 26 to the other 28. In the upper portion of the flag field, the bands 34 run between the first side frame portion 26 to a secondary vertical band 36. The presence of the secondary vertical band 36 provides added strength to the frame 20. A larger void 37 is defined by the vertical band 36, a portion of the horizontal band 32*a*, a part of the first side frame portion 26, and a part of the top frame portion 24. In the preferred embodiment, several of the bands 32, 34, 36 include rearwardly extending posts 38, the location of which is not a limitation of the present invention but rather a design choice. See FIG. 3. The function of the posts 38 will become apparent later in this detailed description. Finally, it should be noted that the frame 20 is fabricated of a light-opaque white plastic material in the preferred embodiment. The color choice is dictated only by the overall design and appearance of the reflector 10 that is desired or required. The most acceptable method of manufacture for the frame 20 is a plastic injection molding process.

Figure 7:
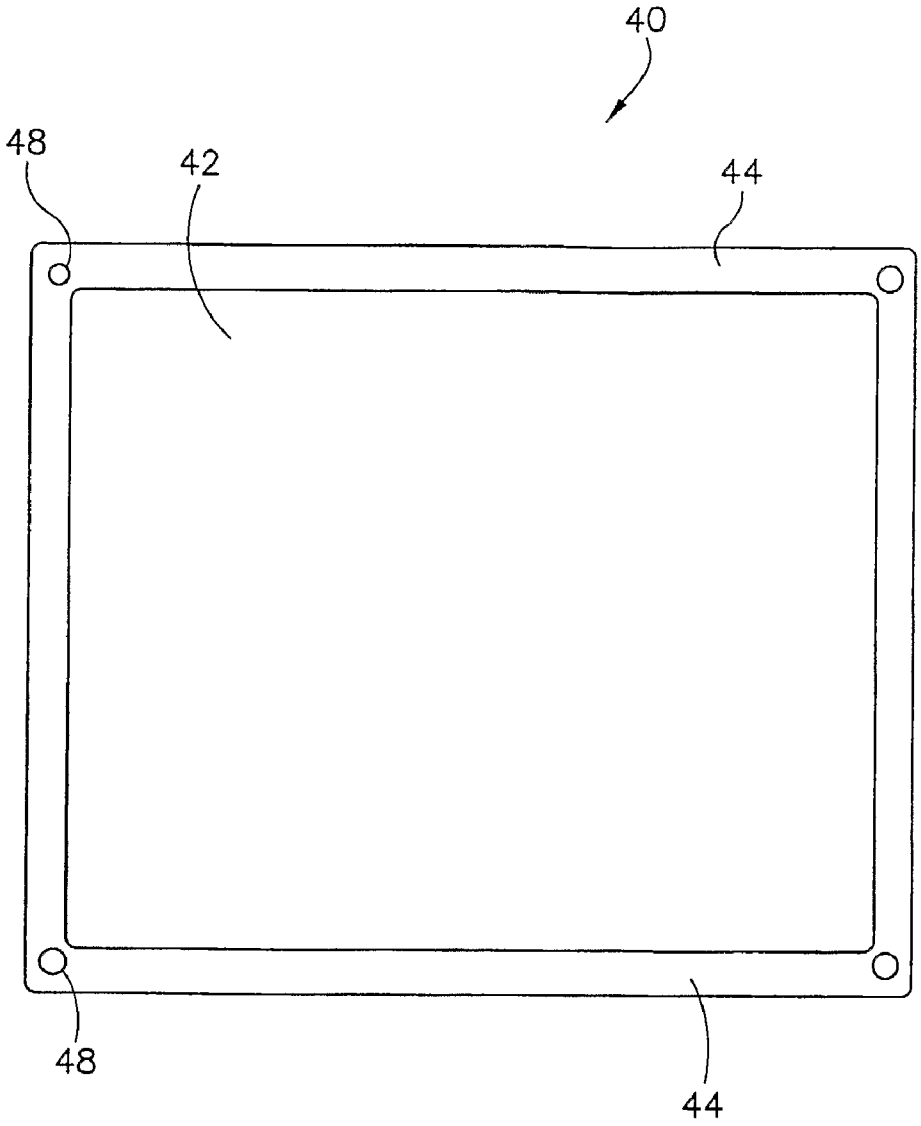
FIG. 7 is an enlarged front elevational view of the second reflector piece shown in FIG. 1.
Figure 8:
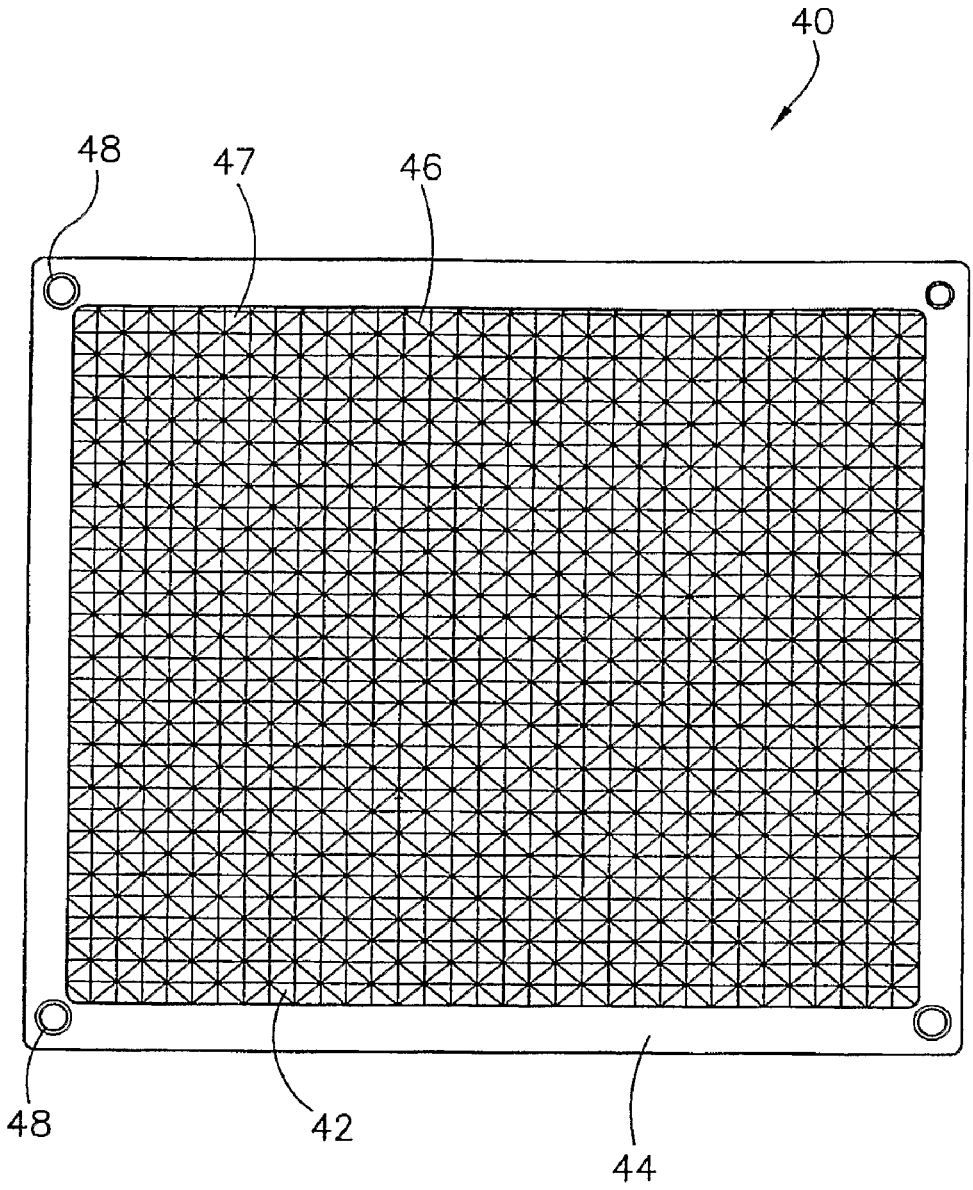
FIG. 8 is a rear elevational view of the second reflector piece shown in FIG. 7.
Figure 11:
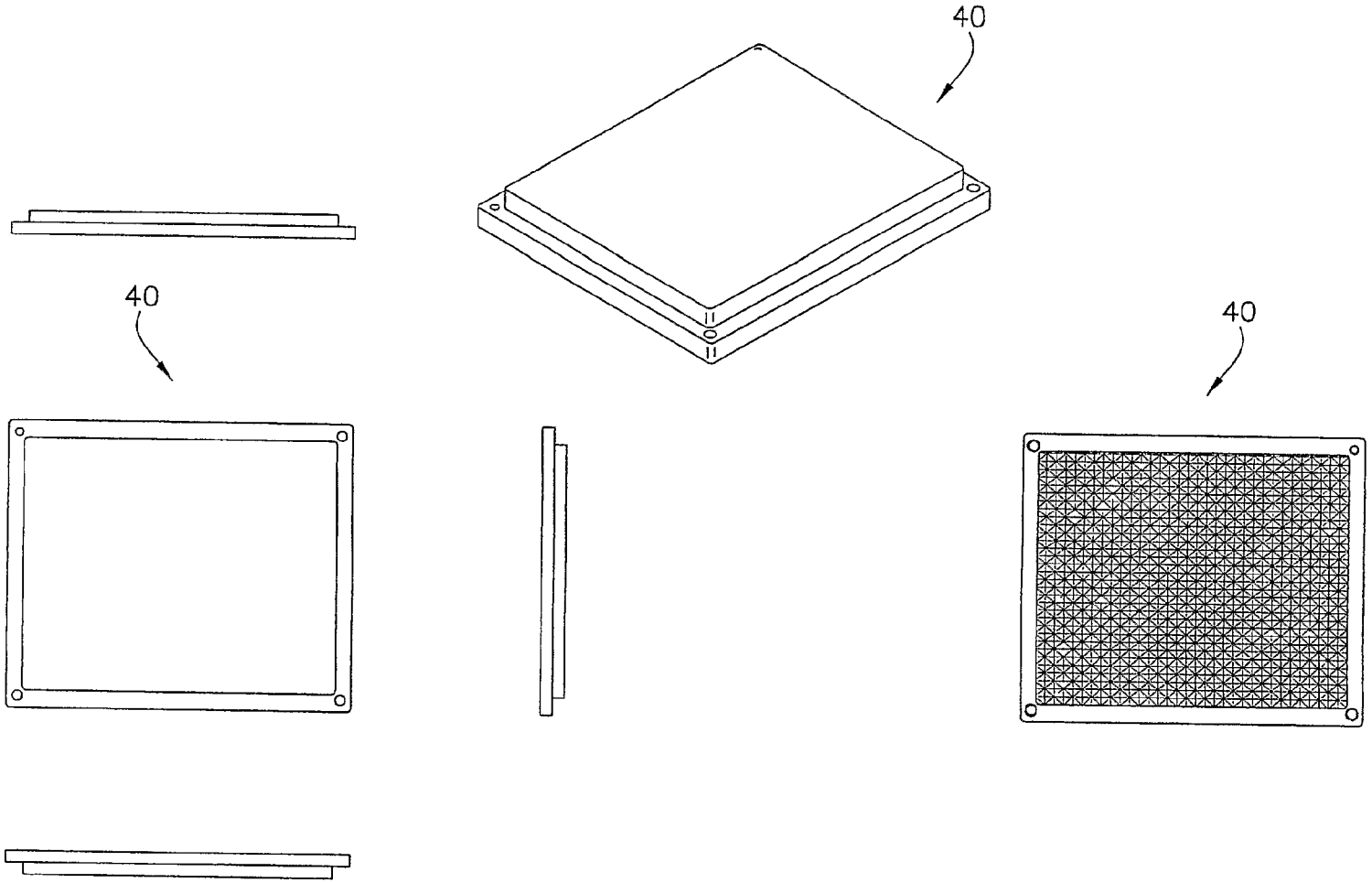
FIG. 11 is a series of reduced elevational, plan and perspective views of the first reflector piece shown in FIG. 1.

As shown in FIGS. 7, 8 and 11, the reflector 10 of the present invention also includes a sheet-like first reflector piece 40. The first reflector piece 40 includes a centrally disposed reflector surface 42 that is surrounded by a flat border 44. As shown in FIG. 8, the reflector surface 42 is made up of a plurality of pyramidal elements 46, the sides 47 of which are intended to reflect light to another adjacent side 47 and then back toward the light source in a generally light-scattering and diffusing manner. It is this structure that provides the reflectivity that is desired and required of the reflector 10 of the present invention.

The border 44 of the first reflector piece 40 includes a plurality of apertures 48, each of which corresponds to a complementary post 38 that extends outwardly from the frame 20. In this fashion, the first reflector piece 40 is essentially "framed" by a portion of the second side member 28 and the secondary vertical band 36 of the frame 20, the posts 38 being functionally adapted to be attachably receivable by the apertures 48. In the preferred embodiment, the first reflector piece 40 is fabricated of a blue colored reflective plastic material that is semi-transparent. It is also representative of the star-field of the flag of the United States.

As shown in FIGS. 4, 5, 6 and 10, the reflector 10 of the present invention also includes a sheet-like second reflector piece 50. The second reflector piece 50 is substantially "L-shaped" in the preferred embodiment. It includes a plurality of centrally disposed reflector surfaces 52, each of which is surrounded by flat border 54, the flat border 54 between adjacent reflector surfaces 52 corresponding to bands 32, 34 of the frame 20. The reflector surfaces 52 are identical in construction to those used in the first reflector piece 40 as described above. See FIG. 5. The border 54 includes a plurality of apertures 58, each of which similarly corresponds to a complementary post 38 that extends outwardly from the frame bands 32, 34. In this fashion, the second reflector piece 50 is also "framed" by the first side member 26, a portion of the second side member 28, the secondary vertical band 36 of the frame 20, the bottom frame member 22, and a portion of the top frame member 24, with the posts 38 being functionally adapted to be attachably receivable by the apertures 58 at various points. In the preferred embodiment, the second reflector piece 50 is fabricated of a red colored reflective plastic material. When contrasted with the white-colored bands 32, 34 of the frame 20, the reflector 10 resembles the red and white stripes of the flag of the United States.

It is to be understood that other designs and other national flags could be configured in this fashion. For example, the national flag of Canada could be replicated using a more substantial white frame portion which surrounds a red-colored reflective maple leaf and includes red-colored reflective and rectangular-shaped fields to either side. This variation (not shown), although different in appearance, would include the basic elements of a frame 20 having strategically-placed posts 38 for being received by one or more apertures 48, 58 of one or more reflector pieces 40, 50. Other variations are also possible without deviating from the scope of this invention.

Once the frame 20 and the reflective fields 40, 50 are assembled as described above, the back of the frame 20 may be covered with a magnetic material such that the reflector 10 adheres to a metal surface, such as a metal mailbox, a car, a boat, or other metal object. The back of the frame 20 may also be covered with an adhesive to allow the reflector 10 to adhere to other non-metallic objects.

In another use, a pair of reflectors 10 may be placed back-to-back and then secured within a frame (not shown), the frame then being attached to a post or stake (also not shown) such that the reflector 10 support can be pushed into the ground and the reflector 10 of the present invention used as a conventional roadway or driveway reflector.

In yet another use, the frame could be comprised of a graphic plate that would include other additional information such as the promotional name of a retailer, address information, phone number information, web-site address information, and so on. In still another use, the frame could be a member similar to that of a motor vehicle license plate holder that would similarly include promotional information as previously described.

Based upon the foregoing, it will be seen that there has been provided a new and useful new and useful reflector that can be used as a safety device and as a message-giving device at the same time; the reflector is easy to fabricate and assemble; the reflector can be mounted to a magnetic or non-magnetic surface, as a stand-alone object, or combined with an advertising frame or other source identifier; and the reflector can be specifically formed into a flag arrangement, using a color scheme such that the reflector replicates the colors of a flag.

We claim:

1. A variably mountable safety and novelty reflector that comprises a reflector frame, said frame including a bottom portion, a top portion, a first side portion, a second side portion, and at least one band extending between any two or more of such frame portions, said at least one band creating frame voids in the frame, and at least one reflector piece, said at least one reflector piece being made of a semi-light-transparent sheet-like reflector piece having a centrally-disposed reflector surface that is surrounded by a flat border and having a reflector surface make up of a plurality of pyramidal elements, the sides of which reflect light to a next adjacent element and then back toward a light source in a generally light-scattering and diffusing manner, wherein the frame has a front face and the frame portions are substantially rearwardly-facing L-shaped members that are functionally adapted to support and cover the edge of the at least one reflector piece when the piece is placed within the frame, wherein the at least one band includes at least one rearwardly-extending post, wherein the border of the at least one reflector piece includes at least one aperture for receiving the post therewithin, and wherein a design is created by said at least one band and said at least one reflector piece at the front side of the frame.

2. The reflector of claim 1 wherein the frame is fabricated of a light-opaque material.

3. The reflector of claim 1 wherein the frame is fabricated of an injection-molded light-opaque white plastic material.

4. The reflector of claim 1 wherein the reflector further comprises a plurality of frame bands and a plurality of reflector pieces, said reflector pieces being fabricated of semi-light-transparent sheet-like reflector pieces of different colors, wherein a design is created by said bands and said reflector pieces at the front side of the frame.

5. The reflector of claim 1 wherein the frame has a rearward side that may be covered with a magnetic material for mounting the reflector to a magnetically-metallic object.

6. The reflector of claim 1 wherein the frame has a rearward side that may be covered with an adhesive material for mounting the reflector to a non-magnetically-metallic or other object.

7. A method for making a variably mountable safety and novelty reflector that comprises the steps of providing a reflector frame, said frame including a bottom portion, a top portion, a first side portion, a second side portion, and at least one band extending between any two or more of such frame portions, said at least one band creating frame voids in the frame, and providing at least one reflector piece, said at least one reflector piece being made of a semi-light-transparent sheet-like reflector piece having a centrally-disposed reflector surface that is surrounded by a flat border and having a reflector surface make up of a plurality of pyramidal elements, the sides of which reflect light to a next adjacent element and then back toward a light source in a generally light-scattering and diffusing manner, wherein the frame has a front face and the frame portions are substantially rearwardly-facing L-shaped members that are functionally adapted to support and cover the edge of the at least one reflector piece when the piece is placed within the frame, wherein the at least one band includes at least one rearwardly-extending post, wherein the border of the at least one reflector piece includes at least one aperture for receiving the post therewithin, and wherein a design is created by said at least one band and said at least one reflector piece at the front side of the frame.

8. The method of claim 7 wherein the frame providing step includes fabricating the frame of a light-opaque material.

9. The method of claim 7 wherein the frame providing step includes fabricating the frame of an injection-molded light-opaque white plastic material.

10. The method of claim 7 wherein the frame providing and reflector piece providing steps further comprise the steps of providing a plurality of frame bands and a plurality of reflector pieces, said reflector pieces being fabricated of semi-light-transparent sheet-like reflector pieces of different colors, wherein a design is created by said bands and said reflector pieces at the front side of the frame.

11. The method of claim 7 wherein the frame providing step includes providing a frame having a rearward side that may be covered with a magnetic material for mounting the reflector to a magnetically-metallic object.

12. The method of claim 7 wherein the frame providing step includes providing a frame having a rearward side that may be covered with an adhesive material for mounting the reflector to a non-magnetically-metallic or other object.

13. The method of claim 7 including the step of mounting the frame within a secondary frame for advertising or promotional purposes.

14. The method of claim 7 including the step of placing a pair of reflectors back-to-back and mounting the frames within a secondary frame that is supported by another means forming a visual display thereby.

* * * * *